US009797173B2

(12) United States Patent
Claxton et al.

(10) Patent No.: US 9,797,173 B2
(45) Date of Patent: Oct. 24, 2017

(54) STAY FOR LOCKING A DOOR, WINDOW OR FLAP IN A PARTLY OPEN POSITION

(71) Applicant: Locklatch (Pty) Ltd, Durbanville (ZA)

(72) Inventors: Nigel Ervine Claxton, Hermanus (ZA); Anthony Bairos, Hermanus (ZA)

(73) Assignee: LOCKLATCH (PTY) LTD, Durbanville (ZA)

( * ) Notice: Subject to any disclaimer, the term of this patent is extended or adjusted under 35 U.S.C. 154(b) by 0 days.

(21) Appl. No.: 14/785,991

(22) PCT Filed: Apr. 22, 2014

(86) PCT No.: PCT/IB2014/060903

§ 371 (c)(1),
(2) Date: Oct. 21, 2015

(87) PCT Pub. No.: WO2014/174436

PCT Pub. Date: Oct. 30, 2014

(65) Prior Publication Data

US 2016/0083983 A1 Mar. 24, 2016

(30) Foreign Application Priority Data

Apr. 26, 2013 (ZA) ..... 2013/03066
May 24, 2013 (ZA) ..... 2013/03786

(51) Int. Cl.
*E05B 15/02* (2006.01)
*E05C 17/50* (2006.01)
(Continued)

(52) U.S. Cl.
CPC ..... *E05C 17/50* (2013.01); *E05B 63/0056* (2013.01); *E05C 17/04* (2013.01); *E05C 17/14* (2013.01); *E05C 17/18* (2013.01)

(58) Field of Classification Search
CPC .. E05B 63/0056; E05B 65/0888; E05C 17/50; E05C 17/04; E05C 17/14; E05C 17/18
(Continued)

(56) References Cited

U.S. PATENT DOCUMENTS 1,120,169 A * 12/1914 Tabor ..... E05C 17/18 292/266
1,125,953 A 1/1915 Brown
(Continued)

FOREIGN PATENT DOCUMENTS

CN 202 431 085 U 9/2012
DE 826108 C 12/1951
(Continued)

OTHER PUBLICATIONS

Supplemental European Search Report dated Oct. 31, 2016 issued in European Application No. 14787779.9, pp. 1-7.

*Primary Examiner* — Hanh V Tran
(74) *Attorney, Agent, or Firm* — Polsinelli PC

(57) ABSTRACT

A stay is provided. A first part (12) including a base (16) for attachment to a wing or to the frame surrounding the wing and an elongate internally threaded tube (24) which is attached to the base (16) in such manner as to be free to pivot with respect to the base. The stay further includes a second part (14) including a rod (58) with threading compatible with that of the tube (24). A locking element (50) with a circumferential groove is attached to and protrudes transversely from the rod (58) and there is a cylindrical element (40) forming part of a base (34) for attachment to the wing or frame. There is first bore in the element (40) for receiving the element (50) and a threaded second bore intersecting the first bore for receiving a cap screw which enters the groove to prevent withdrawal of the element (50) from the first bore. The second bore is closed by a disc (62) with an Allen key
(Continued)

hole opening (64) in it through which the capscrew can be turned.

10 Claims, 5 Drawing Sheets

(51) Int. Cl.
*E05B 63/00* (2006.01)
*E05C 17/04* (2006.01)
*E05C 17/14* (2006.01)
*E05C 17/18* (2006.01)

(58) Field of Classification Search
USPC ..... 292/341.14
See application file for complete search history.

(56) References Cited

U.S. PATENT DOCUMENTS 2,180,578 A * 11/1939 Bradshaw ..... E05C 17/04 292/272
2,714,033 A * 7/1955 Lewgowd ..... E05D 13/06 292/276
3,600,026 A * 8/1971 Savio ..... E05B 65/0888 292/276
3,869,886 A * 3/1975 Diaz ..... E05C 17/04 292/262
3,986,741 A * 10/1976 Giovannini ..... E05C 19/003 292/259 R
4,062,577 A * 12/1977 Butterfield ..... E05C 17/50 292/262
4,691,958 A * 9/1987 Miller ..... E05C 17/50 292/262
6,557,912 B1 5/2003 Truong
9,067,669 B2 * 6/2015 Wheeler ..... B64C 1/06
2007/0029821 A1 * 2/2007 Maeda ..... E05C 17/04 292/338
2007/0052246 A1 * 3/2007 Blomqvist ..... E05C 9/1875 292/39
2007/0209414 A1 * 9/2007 Bentley ..... E05B 65/0888 70/312
2012/0169074 A1 * 7/2012 Sullivan ..... E05C 17/60 292/343

FOREIGN PATENT DOCUMENTS

EP 1 167 668 A2 1/2002
GB 692946 A 6/1953
GB 1 152 361 A 5/1969
JP H08 177293 A 7/1996

* cited by examiner

STAY FOR LOCKING A DOOR, WINDOW OR FLAP IN A PARTLY OPEN POSITION

CROSS REFERENCE TO RELATED APPLICATIONS

This application is a National Phase filing under 35 U.S.C. §371 of PCT/IB2014/060903 filed on Apr. 22, 2014; and this application claims priority to Application No. 2013/03066 filed in South Africa on Apr. 26, 2013, and this application claims priority to Application No. 2013/03786 filed in South Africa on May 24, 2013, under 35 U.S.C. §119. The entire contents of each application are hereby incorporated by reference.

FIELD OF THE INVENTION

THIS INVENTION relates to a stay for locking a door, window or flap in a partly open position.

BACKGROUND TO THE INVENTION

It is often desirable to be able to lock a sliding or swinging door, a hinged or sliding window, a sliding flap or a hinged flap such as hatch cover, in a partially closed position. This allows ventilation but prevents unauthorised entry.

Doors fall into two main categories, those which are on hinges and swing between open and closed positions and those which slide on runners between their open and closed positions. Likewise, windows fall into different categories. Some windows slide, either vertically or horizontally, or swing about top, bottom or side hinges.

As regards flaps, these can slide between open and closed positions or be mounted along one edge by means of hinges so that they swing between open and closed position.

Because of the numerous variations of doors, windows and flaps, structures provided for holding them partly open are only useable with some particular forms of door, window or flap.

The present invention provides a stay which can be used to lock a multitude of differently constructed doors, windows and flaps in a partially open position.

BRIEF DESCRIPTION OF THE INVENTION

According to the present invention there is provided a stay which comprises a first part including a base for attachment to a wing or to the frame surrounding the wing and a first elongate threaded element which is attached to the base in such manner as to be free to pivot with respect to the base, the stay further comprising a second part including a second elongate element with threading compatible with that of the first elongate element, a shaft attached to and protruding transversely from the second element and a base for attachment to the wing or frame, there being a first bore in said base of the first element for receiving said shaft and a second bore intersecting said first bore for receiving a locking element to prevent withdrawal of the shaft from the first bore.

In the preferred form said second bore and said locking element are threaded so that the locking element can be screwed into the second bore.

The locking element can be a capscrew with an Allen key socket. Said shaft can have a groove in it for receiving the tip of the locking element.

The base of the first part can include a shackle of U-shape and there can be a hole in said first elongate element through which the shackle passes freely thereby providing the first elongate element with freedom to move with respect to the shackle.

One of said elongate elements can be in the form of an internally threaded tube and the other of said elongate elements can be in the form of a threaded rod which can be screwed into said tube.

In a further form there can be a further bore in said base of the second part which further bore is at right angles to said first bore and is intersected by the second bore.

The term "wing" is used herein to mean the moving part of a hinged door, a sliding door, a hinged window, a sliding window, a hinged flap and a sliding flap.

The wing can, using the stay of the present invention, be held in the required partly open position and locked in that position.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

The stay illustrated is designated 10 and comprises a first part 12 which is fitted either to a wing or to a frame and a second part 14 which is fitted either to a frame or to a wing. It will be noted that the Figures of the drawings are not all drawn to the same scale.

Figure 1:
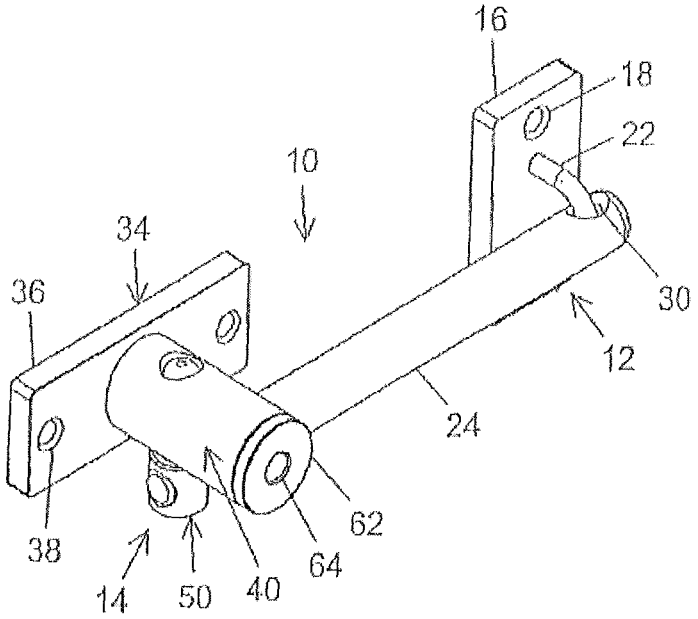
FIG. 1 is a pictorial view of a stay.
Figure 2:
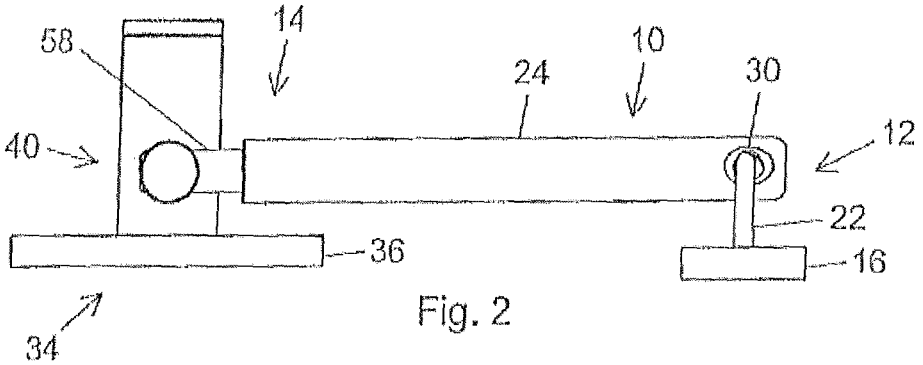
FIG. 2 is a side elevation of the stay of FIG. 1.
Figure 3:
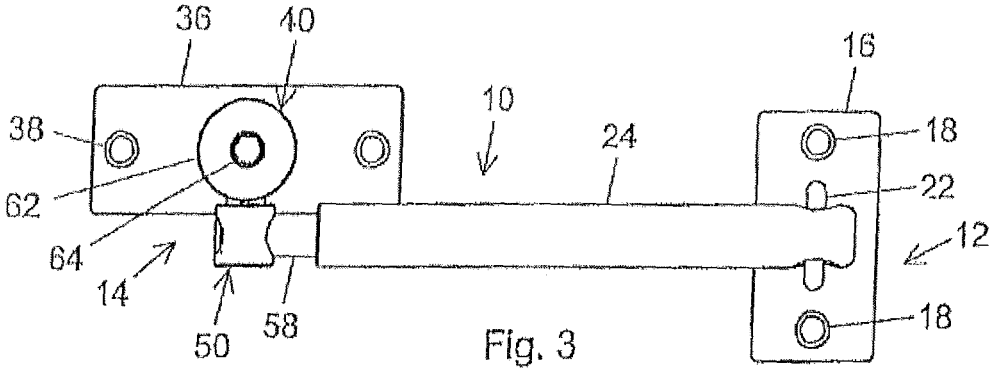
FIG. 3 is a top plan view of the stay.
Figure 4:
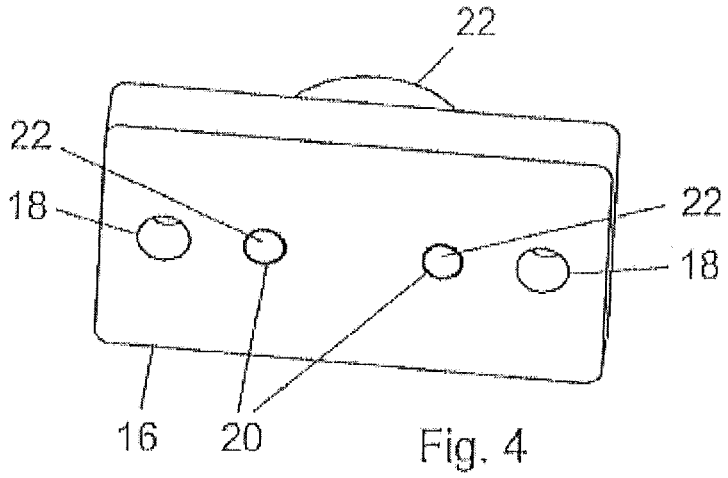
FIG. 4 is a pictorial view of the underside of a first base.

The part 12 comprises a base 16 which is secured by screws passed through holes 18 in the base 16. The base 16 has two further holes 20 (see FIG. 4) which receive the straight limbs of a U-shaped shackle 22. The free ends of the shackle 22 can be welded to the underside of the base 16 or protruding ends of the shackle can be swaged to secure the shackle to the base.

Figure 5:
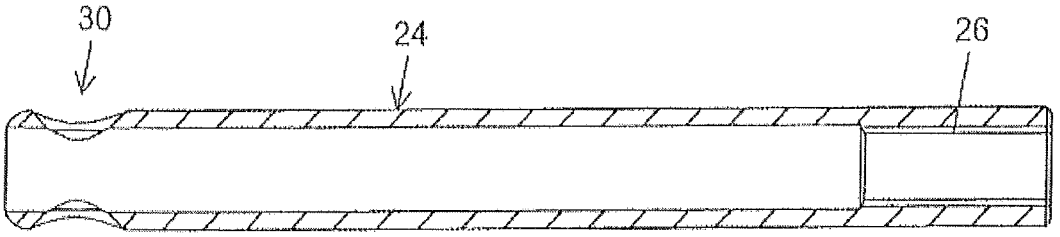
FIGS. 5 and 6 are sections through of a tube taken at right angles to one another.
Figure 6:
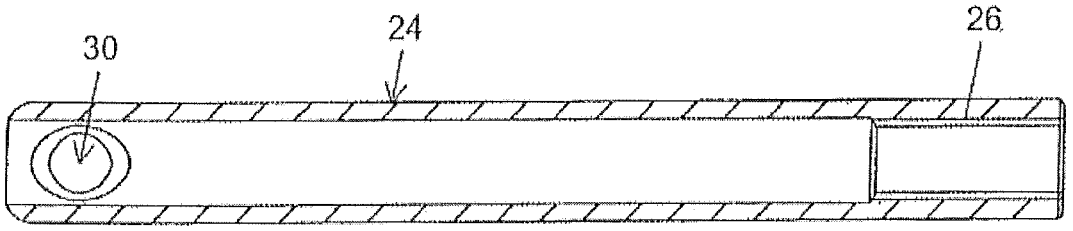

Part of the length of one end of a tube 24 (FIGS. 5 and 6) has internal threading 26 and the other end of the tube has a hole 30 in it. The shackle 22 passes freely through the hole 30. In a modified form of the structure illustrated, the end portion of the tube 24 is flattened and the flattened end portion is then punched to form the hole 30.

Figure 8:
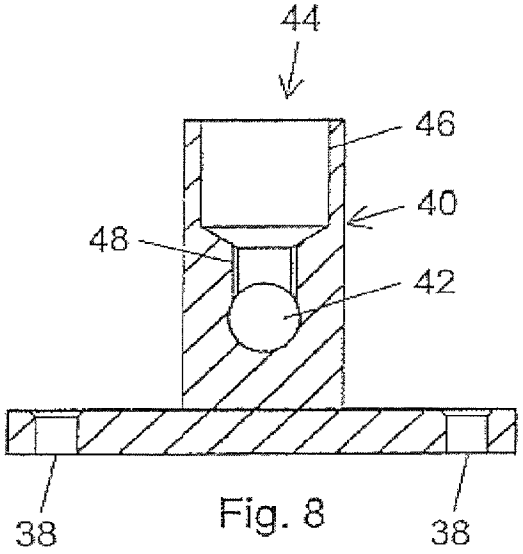
FIG. 8 is an axial section through the second base.
Figure 9:
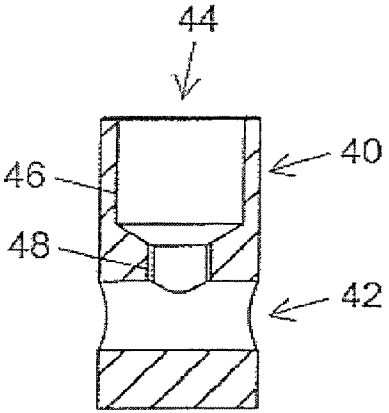
FIG. 9 is an axial section through the cylindrical element of the second base, the section of FIG. 9 being at right angles to the section of FIG. 8.

The second part 14 includes a base designated 34 (see FIGS. 7 and 8) which comprises a plate 36 with two screw holes 38 in it and a cylindrical element 40 (FIGS. 8 and 9). The element 40 is formed with a transverse bore 42 and an axial bore 44 which intersects the bore 42. The bore 44 has a plain upper section 46 and a smaller diameter threaded lower section 48.

Figure 10:
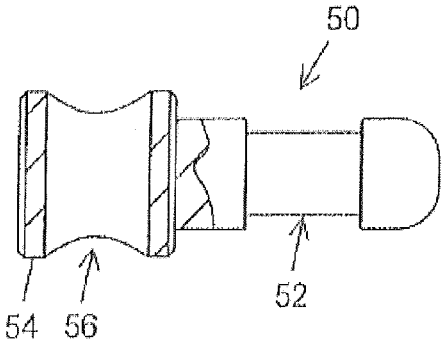
FIGS. 10 and 11 are side elevations of a locking element taken at right angles to one another, FIG. 10 being partly in section.
Figure 11:
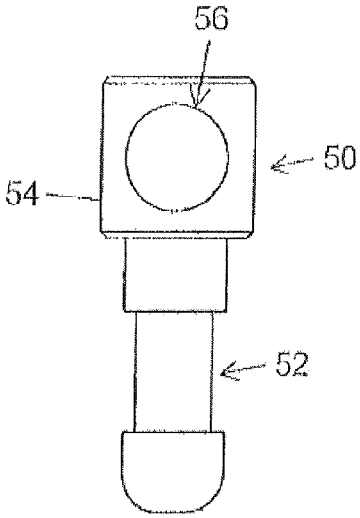

An elongate locking element (FIGS. 10 and 11) is designated 50 and is constituted by a shaft which has a circumferentially extending groove 52 between its ends. One end of the shaft is in the form of a cylindrical boss 54 which has a transverse bore 56 in it.

Figure 12:
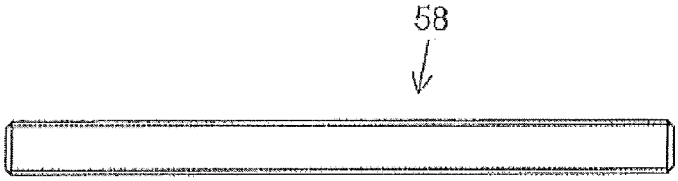
FIG. 12 is an elevation of a threaded rod.

The part 14 also comprises a threaded rod 58 (FIG. 12) one end of which is welded into the bore 56 and the other end of which is, in use, screwed into the threading 26 of the tube 24. It will be understood that the positions of the rod 58 and tube 24 can be reversed.

Figure 13:
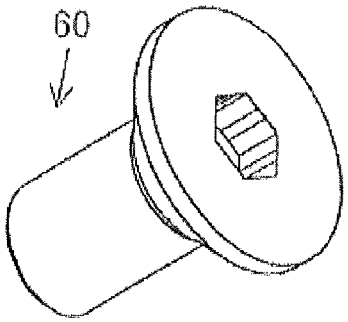
FIG. 13 is a pictorial view of a capscrew.
Figure 14:
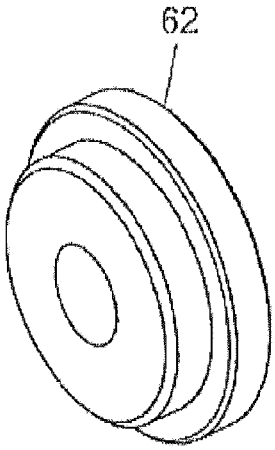
FIG. 14 is a pictorial view of a cap.

A cap screw 60 (FIG. 13) is, in use, inserted into the bore 44 (FIGS. 8 and 9) and screwed into the section 48. When the capscrew is fully screwed in, the tip of the capscrew is in the bore 42. A disc 62 (FIG. 14) is pressed into the open end of the bore 44. The disc 62 has in it an opening 64 of a size to permit an Allen key to be inserted to turn the capscrew 60.

With the parts 12 and 14 separated by unscrewing the rod 58 from the tube 24, either the base 16 or the base 34 is attached to the frame which surrounds the wing. The other base is attached to the movable wing. The degree to which the wing is to be held open is decided upon and the rod 58 screwed into the tube 24 so that the stay is of the requisite length.

The locking element 50 is pushed into the bore 42. The groove 52 comes into register with the bore 44 where it intersects with the bore 42. The capscrew 60 is in its withdrawn condition at this time. The screw is then tightened so that its tip enters the groove 52 thus preventing the element 50 being withdrawn from the bore 42.

The wing is thus locked in a partly open position, but cannot be opened further unless the capscrew is unscrewed to release the locking element 50 from the element 40.

Figure 7:
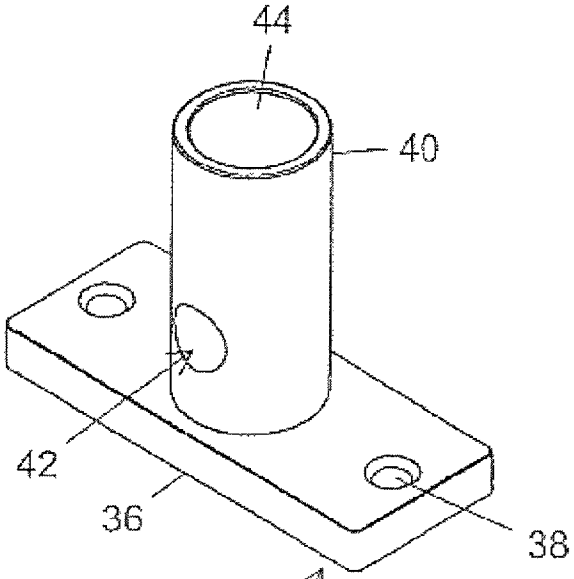
FIG. 7 is a pictorial view of a second base.
Figures 15, 16:
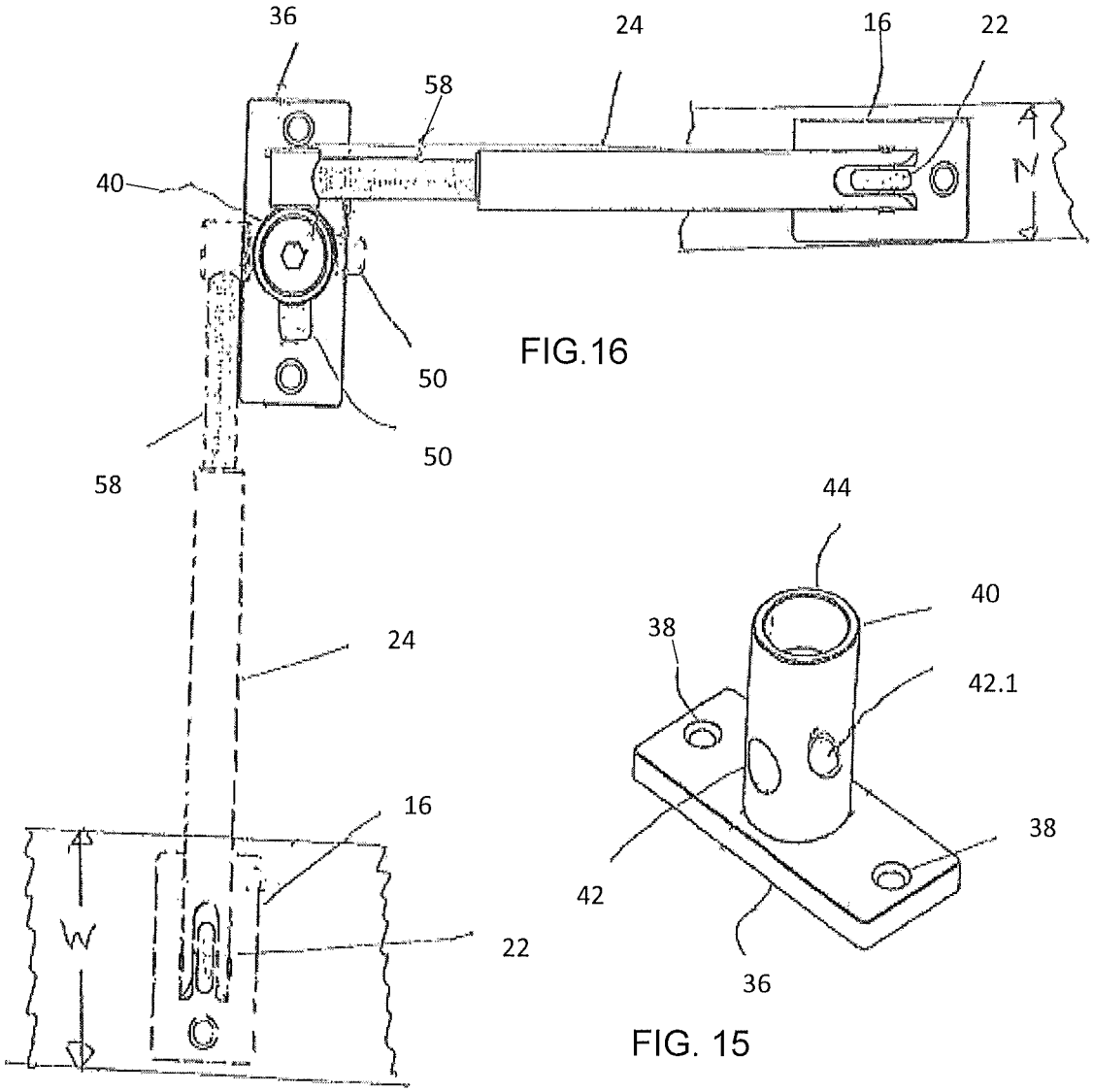
FIG. 15 is a view similar to that of FIG. 7 of a modified form of the second base.
FIG. 16 is a plan view illustrating the use of the base of FIG. 15.

The base of FIG. 15 differs from that of FIG. 7 in that there is in the element 40 a second bore, designated 42.1, which is at right angles to the bore 42.

In FIG. 16 the components are shown in two different positions. In the full line position the plate 16 is aligned with the tube 24 and at right angles to the plate 36. Insofar as the components shown in dotted lines are concerned, the plate 16 is aligned with both the tube 24 and the plate 36. These configurations are achieved by moving the element 50 from one of the two bores 42, 42.1 to the other. This enables the stay to be fitted to a bar of narrow width N or to a bar of greater width W.

In this Figure the end of the tube 24 is forked, the tines of the fork having aligned holes in them. A pin passes through these holes and through the shackle 22 to secure the tube 24 to the plate 16.

In a further form, the end of the tube is split and then flattened. A hole is then drilled through the flattened end and the shackle 22 passed through the drilled hole before being welded to the plate 16. The pin can consequently be omitted. This construction reduces "chatter" if a strong wind is blowing through the door, window or hatchway.

The invention claimed is:

1. A stay which comprises a first part including a base for selective attachment to a wing or to a frame surrounding said wing and a first elongate threaded element which is attached to said base in such manner as to be free to pivot with respect to the base, the stay further comprising a second part including a second base for selective attachment to the frame or to the wing whereby the stay forms a link between the wing and the frame, a second elongate element with threading compatible with that of the first elongate element, a shaft attached to and protruding transversely from the second elongate element the shaft having a circumferential groove and the second base having a first bore for receiving said shaft and a second bore intersecting said first bore and a locking element for insertion into said second bore so that it enters said groove of the shaft to prevent withdrawal of the shaft from the first bore, wherein the base of the first part includes a shackle of U-shape, there being a hole in said first elongate element through which the shackle passes freely thereby providing the first elongate element with freedom of motion in three axes with respect to the shackle.

2. A stay as claimed in claim 1, wherein the locking element is a capscrew with an Allen key socket.

3. A stay as claimed in claim 1, wherein one of said elongate elements is in the form of an internally threaded tube and the other of said elongate elements is in the form of threaded rod which can be screwed into said tube.

4. A stay as claimed in claim 2, wherein one of said elongate elements is in the form of an internally threaded tube and the other of said elongate elements is in the form of threaded rod which can be screwed into said tube.

5. A stay as claimed in claim 2, and including a further bore in said base of the second part which further bore is at right angles to said first bore and is intersected by the second bore.

6. A stay as claimed in claim 1, and including a further bore in said base of the second part which further bore is at right angles to said first bore and is intersected by the second bore.

7. The stay of claim 1, wherein the second base includes a mounting portion and a cylindrical extension defining a cylinder, the first bore extending through the cylinder perpendicular to a central axis of the cylinder.

8. The stay of claim 7, wherein the freedom of motion permits the first elongate element to move perpendicular to the first bore of the second base to thereby bring the shaft to the first bore where the shaft can be inserted into the cylinder perpendicular to a central axis of the cylinder.

9. The stay of claim 7, wherein the second bore is parallel with the central axis of the cylinder.

10. The stay of claim 8, wherein the second bore is parallel with the central axis of the cylinder.

* * * * *